US011203919B1

(12) United States Patent
Guidry et al.

(10) Patent No.: US 11,203,919 B1
(45) Date of Patent: Dec. 21, 2021

(54) METHOD AND APPARATUS FOR FLUID JETTING OF WELLBORES AND OTHER SURFACES

(71) Applicant: WORKSTRINGS INTERNATIONAL, LLC, Broussard, LA (US)

(72) Inventors: Derek Guidry, Sunset, LA (US); William Steele, Conception Bay South (CA)

( * ) Notice: Subject to any disclaimer, the term of this patent is extended or adjusted under 35 U.S.C. 154(b) by 0 days.

(21) Appl. No.: 17/126,405

(22) Filed: Dec. 18, 2020

Related U.S. Application Data

(60) Provisional application No. 62/950,534, filed on Dec. 19, 2019.

(51) Int. Cl.

| | |
|---|---|
| ***E21B 29/00*** | (2006.01) |
| ***E21B 37/00*** | (2006.01) |
| ***E21B 41/00*** | (2006.01) |
| ***E21B 7/06*** | (2006.01) |
| ***E21B 17/042*** | (2006.01) |

(52) U.S. Cl.
CPC ..... *E21B 41/0078* (2013.01); *E21B 7/065* (2013.01); *E21B 17/0426* (2013.01)

(58) Field of Classification Search
CPC ..... E21B 29/00; E21B 37/00; E21B 41/0078
See application file for complete search history.

(56) References Cited

U.S. PATENT DOCUMENTS

| | | | | |
|---|---|---|---|---|
| 3,066,735 | A * | 12/1962 | Zingg | E21B 7/18 175/234 |
| 3,165,918 | A * | 1/1965 | Loomis | G01M 3/2853 73/40.5 R |
| 3,912,173 | A * | 10/1975 | Robichaux | E21B 21/00 239/443 |
| 4,392,534 | A * | 7/1983 | Miida | E21B 10/18 175/340 |
| 4,899,821 | A * | 2/1990 | Casida | E21B 34/12 166/222 |
| 8,931,559 | B2 * | 1/2015 | Getzlaf | E21B 17/1078 166/319 |
| 2004/0112645 | A1 * | 6/2004 | Eppink | E21B 21/103 175/61 |
| 2013/0192818 | A1 * | 8/2013 | Winn | E21B 37/02 166/173 |
| 2014/0311528 | A1 * | 10/2014 | Hallundbæk | E21B 37/00 134/22.12 |
| 2015/0337612 | A1 * | 11/2015 | Heil | E21B 17/20 166/285 |
| 2018/0003013 | A1 * | 1/2018 | Jackson | F04B 53/126 |

(Continued)

*Primary Examiner* — Kipp C Wallace
(74) *Attorney, Agent, or Firm* — Ted M. Anthony

(57) ABSTRACT

A multi-functional jetting tool can be installed within a tubular work string, or attached to the distal or leading end of the tubular work string, in order to facilitate improved cleaning of downhole and/or subsea equipment—and particularly equipment with internal recesses, cavities or crevasses. A bull nose cap member, which can be constructed of plastic or other non-abrasive material, can be attached when the jetting tool is run on the distal end of a tubular work string. Fluid jetting ports can be selectively equipped with standard-sized or adjustable nozzles, thereby permitting customized fluid jet flow pattern from the jetting tool along the tool body in multiple directions for desired applications.

3 Claims, 8 Drawing Sheets

(56) References Cited

U.S. PATENT DOCUMENTS

| | | | | |
|---|---|---|---|---|
| 2018/0320497 | A1* | 11/2018 | Garcia | E21B 44/00 |
| 2019/0120035 | A1* | 4/2019 | Livescu | E21B 34/14 |
| 2020/0190917 | A1* | 6/2020 | Farley | E21B 17/14 |

* cited by examiner

METHOD AND APPARATUS FOR FLUID JETTING OF WELLBORES AND OTHER SURFACES

BACKGROUND OF THE INVENTION

1. Field of the Invention

The present invention pertains to a jetting sub assembly. More particularly, the present invention pertains to a multi-functional jetting sub assembly that can be run in-line, as a component part of a conventional tubular work string, or on the distal or leading end of said work string. More particularly still, the present invention permits improved jet fluid cleaning of downhole and/or subsea equipment including, without limitation, equipment having internal cavities and/or crevasses such as, for example, blow out preventers, wellheads, subsea trees.

2. Brief Description of the Prior Art

Oil and gas wells frequently include equipment or structures that have or define internal cavities or crevasses. Such equipment includes, but is not necessarily limited to, blow out preventers ("BOPs"), wellheads and subsea trees/production equipment. Frequently, drilling mud, drill cuttings and/or other debris (typically from drilling or other wellbore operations) can inadvertently collect or accumulate within such internal spaces; such accumulations can adversely affect the operation of such equipment and create unsafe or other undesirable conditions.

Jetting tools can be used to direct pressurized fluid at internal surfaces of said equipment in order to remove or clean such accumulations from said surfaces, and thereafter circulate debris or other solids from a wellbore. Typically, such conventional jetting tools are conveyed within a wellbore to a desired depth (such as, for example, adjacent to or in the vicinity of the equipment to be cleaned) on drill pipe or other tubular work string. Pressurized fluid is then pumped through the tubular work string and jetting tool at the inner surface(s) of such equipment. The pressurized fluid acts to loosen and clean any accumulated solids from the inner surfaces of such equipment and, eventually, lift such debris or other solids out of a well.

Such conventional jetting tools have a number of important deficiencies including, without limitation, the inability to provide a desired fluid spray pattern, inability of quick and efficient tool re-dressing/re-configuration (especially on location) and/or the requirement to make multiple/redundant pipe trips to ensure thorough cleaning of downhole equipment. Thus, there is a need for a robust, versatile and effective jetting tool as more fully disclosed herein.

SUMMARY OF THE INVENTION

In a preferred embodiment, the present invention comprises a versatile and multi-functional jetting tool assembly designed to be installed within a tubular work string ("in-line"), attached to the distal or leading end of said tubular work string, or both. Said jetting tool assembly facilitates improved cleaning of downhole equipment within a wellhead, especially equipment having internal recesses, cavities or crevasses such as, for example, BOPs, wellheads, subsea trees.

The method and apparatus of the present invention improves fluid jetting/cleaning of well equipment and can be used in connection with multiple different wellbore operations such as, for example, drilling fluid displacement, completion fluid displacement, equipment maintenance, and/or other operational scenarios. Improvement in cleaning efficiency not only benefits wellbore operations and functioning of downhole equipment, but also health, safety and environmental characteristics of such operations—frequently by reducing the number and complexity of operations required. Moreover, the method and apparatus of the present invention allows users to design or "customize" desired fluid jet flow patterns; different configurations feature removable ("drop-in") nozzles, O-ring's and retaining rings.

In a preferred embodiment, the jetting sub assembly of the present invention comprises a substantially tubular sub collar having conventional pin and box end threaded connections for inclusion within, or at the distal end of, a conventional tubular work string. The present invention can beneficially have the same threaded end connections as drill pipe and, thus, can be installed in-line with a drill string such as, for example, for jetting in a short trip of downhole equipment (including, without limitation, BOPs, wellheads, subsea equipment and trees). A central through bore extends along the longitudinal axis of said sub collar.

In a preferred embodiment, the present invention further comprises a bull nose sub. Said bull nose sub can be attached to said sub collar to form a combined assembly, typically for use when said jetting tool is run on the distal or leading end of a tubular work string (such as, for example, as part of a "dedicated" run wherein a jetting operation may be the sole purpose for a pipe run). Alternatively, as noted above, said in-line jetting assembly can be run without said bull nose sub as a component part of said tubular work string. A central through bore extends along the longitudinal axis of said bull nose sub, and can be aligned with the central through bore of said sub collar.

The jetting sub assembly of the present invention also comprises at least one jetting port that can be equipped with a removable and replaceable fluid nozzle. In a preferred embodiment, each nozzle comprises a conventional and readily available nozzle; each of said jetting ports can accept a conventional tri-cone bit nozzle that is beneficially readily available (that is, "off the shelf") and easier to install and remove than screw-in type nozzles. Such nozzles can be dressed open or closed in order to direct desired fluid flow and total flow area ("TFA").

By way of illustration, but not limitation, said fluid spray pattern can be directed at virtually any desired angle relative to the longitudinal axis of said jetting sub assembly and surrounding wellbore; for example, said spray pattern can be directed (relative to the longitudinal axis of the jetting sub assembly) up-hole, down-hole, radially outward (that is, at approximately 90 degrees), or blanked off entirely. The present invention provides flexibility to adjust fluid flow pattern, nozzle size, and TFA at virtually any position along the length of the tool body in multiple directions for desired applications. Further, a user can design different bore or port spray patterns as desired, as well as different nozzle sizes or blanks to control jetting pattern and/or fluid flow rate.

A bull nose end cap is operationally attached to the distal end of the jetting sub assembly. Said bull nose cap can be constructed of urethane or other non-abrasive material, and acts to reduce abrasion, gouging or other damage to downhole equipment (such as, for example, when the jetting sub assembly of the present invention is being moved in or out of a wellbore, or reciprocated within said well). Port(s) in said bull nose end cap can also accept drop-in nozzles similar to conventional tri-cone bit nozzles that are readily available and easier to install and remove than screw-in type nozzles; said drop-in nozzles can be generally available in multiple different sizes, thereby permitting re-dressing or reconfiguring of the jetting sub assembly on location (such as on a drilling rig), as well as customization of desired fluid jetting pattern(s), including, without limitation, to satisfy particular job parameters. Further, ports can be selectively closed off or flow restricted, either in said end cap or along the body of the jetting sub assembly.

The jetting sub assembly of the present invention comprises multiple nozzle ports allowing for operational flexibility to be run fully-open, partially open, or blanked-off. The jetting sub assembly also comprises a nose port that can be blanked off and run in a drill string during short trips without having to run a valve below the jetting sub (like with conventional jet subs). The bull nose end of the present invention also has a nose port that allows a user to dress as needed to run open or closed ended, compared to a conventional bullnose tools having a fixed open port.

The jetting sub assembly of the present invention provides for improved jetting/cleaning of internal surfaces of BOP, wellhead, and subsea equipment due to improved jet configuration and, thus, improved fluid spray pattern and/or jetting coverage. Further, the jetting sub assembly of the present invention provides enhanced versatility and adjustability for directional fluid jetting, along with adjustability of nozzle size and configuration selection. The jetting sub assembly of the present invention further provides improved cleanliness of BOP's and other well equipment, thereby reducing surface maintenance requirements and improving health, safety and environmental performance.

The jetting sub assembly of the present invention also saves rig time. Rig time and associated costs can be saved by reducing the number pipe trips required, as well as the time required to conduct jetting operations.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
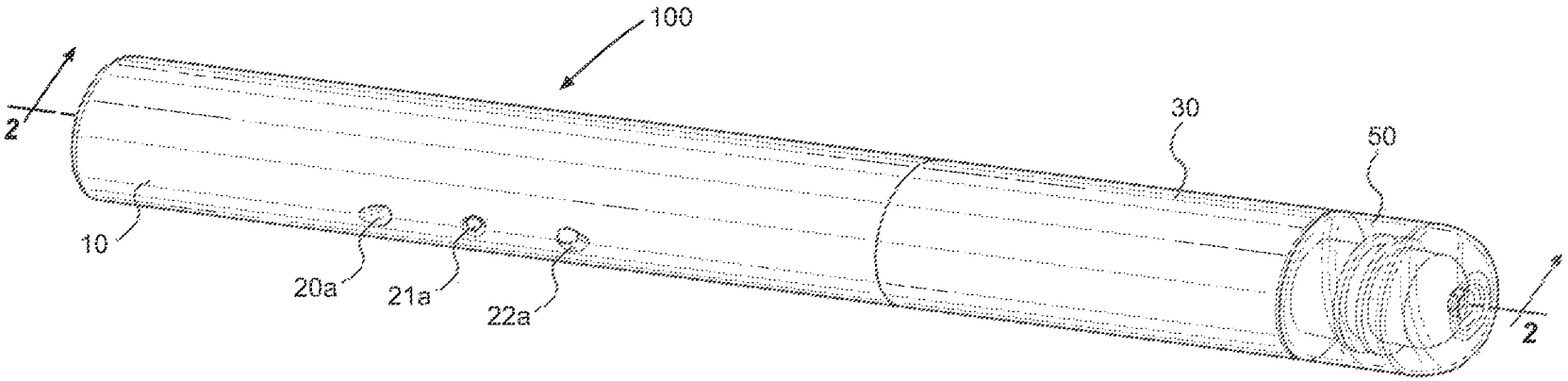
FIG. 1 depicts a side perspective view of a jetting sub assembly of the present invention.

Referring to the drawings, FIG. 1 depicts a side perspective view of a jetting sub assembly 100 of the present invention. Jetting sub assembly 100 comprises first sub member 10, second sub member 30 and bull nose end cap 50. In a preferred embodiment, said first sub member 10 and second sub member 30 both have an outer surface defining a substantially cylindrical shape and are joined in linear alignment along their longitudinal axes. Ports 20*a*, 21*a* and 22*a* extend through said jetting sub assembly 100; in a preferred embodiment, said ports 20*a*, 21*a* and 22*a* are positioned along the length of first sub member 10. As depicted in FIG. 1, said ports 20*a*, 21*a* and 22*a* are substantially linearly aligned along the longitudinal axis of first sub member 10; however, it is to be observed that said ports 20*a*, 21*a* and 22*a* (as well as any other ports) may be oriented in spaced arrangement or phased around the outer circumference of said first sub member 10.

As set forth more fully herein, jetting sub assembly 100 comprises a multi-functional jetting tool assembly that can be installed as a component part within a tubular work string ("in-line"), attached to the distal or leading end of said tubular work string, or both. Said jetting tool assembly 100 facilitates improved cleaning of downhole equipment within a wellhead, especially equipment having internal recesses, cavities or crevasses such as, for example, BOPs, wellheads, subsea trees. Further, jetting sub assembly 100 improves fluid jetting/cleaning of wellbores and well equipment and can be used in connection with multiple operations such as, for example, drilling fluid displacement, completion fluid displacement, equipment maintenance, and other functional operations.

Figure 2:
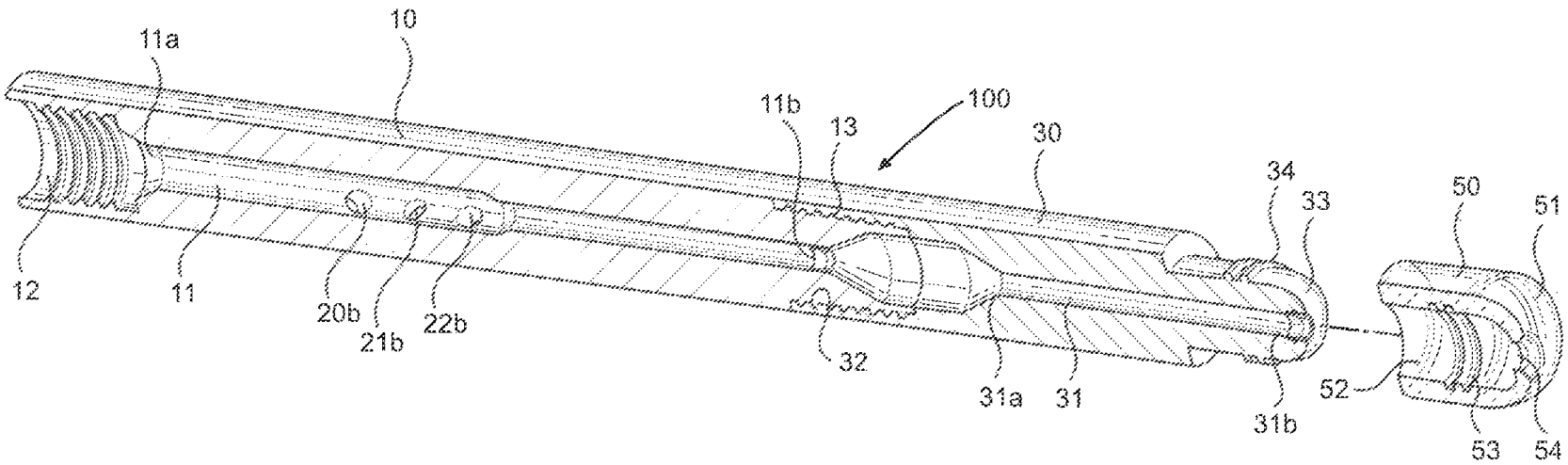
FIG. 2 depicts a side sectional and perspective view of a jetting sub assembly of the present invention.

FIG. 2 depicts a side sectional, perspective and partially exploded view of jetting sub assembly 100 of the present invention along line 2-2 of FIG. 1. Jetting sub assembly 100 comprises first sub member 10, second sub member 30 and bull nose end cap 50. First sub member 10 has central through bore 11 having first end 11*a* and second end 11*b*. A first connection member 12 is disposed near said first end 11*a*; in a preferred embodiment, said first connection member 12 comprises a female or "box-end" threaded connection. A second connection member 13 is disposed near said second end 11*b*; in a preferred embodiment, said second connection member 13 comprises a male or "pin-end" threaded connection. Internal ports 20*b*, 21*b* and 22*b* are positioned along the length of first sub member 10 and open into central through bore 11. First connection member 12 and second connection member 13 can comprise conventional threaded connections allowing for inclusion of first sub member 10 within, or at the distal end of, a conventional tubular work string (such as, for example, drill pipe or a tubular landing string).

Second sub member 30 has central through bore 31 having first end 31*a* and second end 31*b*. Connection member 32 is disposed near said first end 31*a*; in a preferred embodiment, said connection member 32 comprises a female or "box-end" threaded connection. Bull nose extension member 33 is disposed near said second end 31*b*. In a preferred embodiment, retaining rings 34 are disposed around said bull nose extension member 33.

Bull nose end cap 50 generally comprises a cap member having a rounded leading end surface 51 and central bore 52.

Said central bore 52 is sized and configured to be received on bull nose extension member 33. Inner profile 53 can engage and mate with retaining rings 34 to operationally secure said bull nose end cap 50 to said bull nose extension member 33. End port 54 extends through said rounded end surface 51 of bull nose end cap 50 and is generally aligned with bore 31 when said end cap 50 is installed on said bull nose extension member 33.

Figure 3:
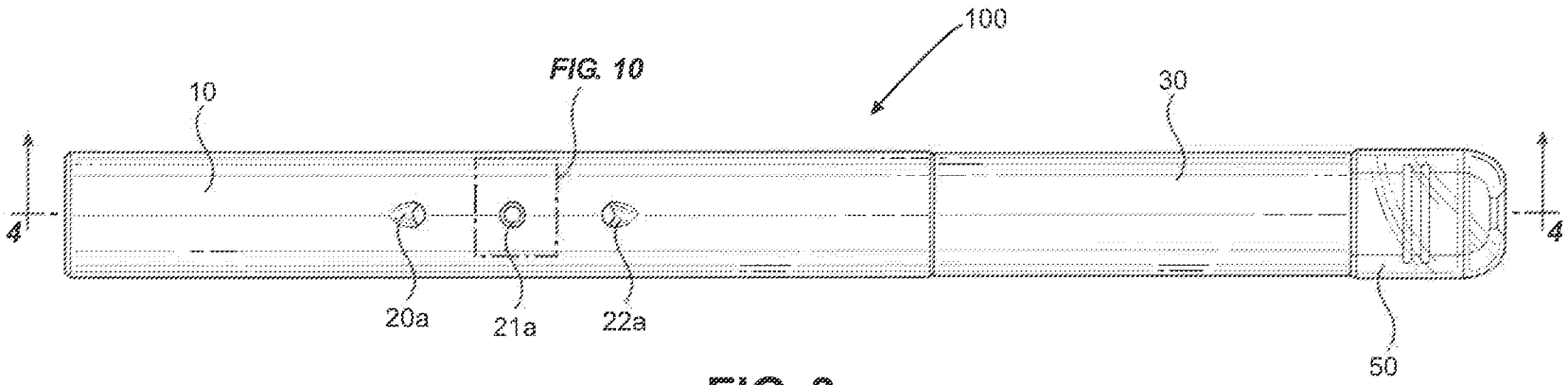
FIG. 3 depicts a side view of a jetting sub assembly of the present invention.

FIG. 3 depicts a side view of a jetting sub assembly 100 of the present invention, rotated about its central longitudinal axis compared to the view depicted in FIG. 1. Jetting sub assembly 100 comprises first sub member 10, second sub member 30 and attached bull nose end cap 50. At least one port 20*a*, 21*a* and 22*a* extend through said jetting sub assembly 100; in a preferred embodiment, said ports 20*a*, 21*a* and 22*a* are positioned along the length of first sub member 10. As depicted in FIG. 2 (and also FIG. 1), said ports 20*a*, 21*a* and 22*a* are substantially linearly aligned along the length of first sub member 10. However, it is to be observed that said ports 20*a*, 21*a* and 22*a* are illustrative examples only; said ports, which can number more or less than three, may be oriented in spaced arrangement or phased around the outer circumference of said first sub member 10.

Figure 4:
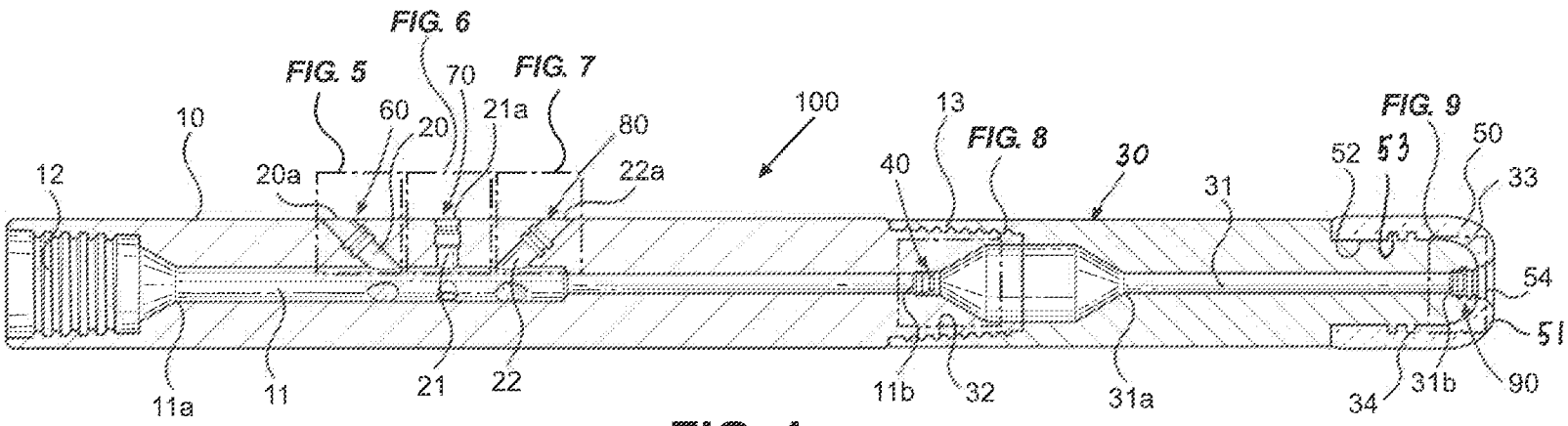
FIG. 4 depicts a side sectional view of a jetting sub assembly of the present invention.

FIG. 4 depicts a side sectional view of a jetting sub assembly of the present invention along lines 4-4 of FIG. 3. Jetting sub assembly 100 comprises first sub member 10, second sub member 30 and bull nose end cap 50. First sub member 10 has central through bore 11 having first end 11*a* and second end 11*b*. A first connection member 12 is disposed near said first end 11*a*; in a preferred embodiment, said first connection member 12 comprises a female or "box-end" threaded connection. A second connection member 13 is disposed near said second end 11*b*; in a preferred embodiment, said second connection member 12 comprises a male or "pin-end" threaded connection.

In the embodiment depicted in FIG. 4, bores 20, 21 and 22 are positioned along the length of first sub member 10. Said bores 20, 21 and 22 extend from central through bore 11 to the external or outer surface of first sub member 10, where said bores 20, 21 and 22 terminate at ports 20*a*, 21*a* and 22*a*, respectively. Further, in a preferred embodiment, bores 20 and 22 are each oriented at an acute angle relative to the longitudinal axis of central through bore 11, while bore 21 is a transverse bore oriented at right angle relative to said longitudinal axis of central through bore 11. First nozzle assembly 60 is disposed within bore 20, second nozzle assembly 70 is disposed within bore 21 and third nozzle assembly 80 is disposed within bore 22.

It is to be observed that the number, position and orientation of bores 20, 21 and 22 (or other such bores that may be selectively added) of jetting sub assembly of the present invention can be specifically designed to enhance jetting and improve fluid spray pattern and/or coverage. By way of illustration, but not limitation, said fluid spray pattern can be directed at virtually any desired angle relative to the longitudinal axis of said jetting sub assembly and surrounding wellbore. The present invention provides flexibility to adjust fluid flow pattern, nozzle size, and total flow area (TFA) at virtually any position along the length of the length of jetting sub assembly 100 in multiple directions for desired applications. Further, a user can selectively design different bore or hole patterns, bore or hole orientations, nozzle sizes or blanks to control jetting pattern and/or fluid flow rate as desired.

Second sub member 30 has central through bore 31 having first end 31*a* and second end 31*b*. Connection member 32 is disposed near said first end 31*a*; in a preferred embodiment, said connection member 32 comprises a female or "box-end" threaded connection. Bull nose extension member 33 is disposed near said second end 31*b*; retaining rings 34 are disposed around said bull nose extension member 33. In-line nozzle assembly 40 is disposed within bore 11, typically near end 11*b* of said bore 11. Similarly, end nozzle assembly 90 is disposed within bore 31, typically near end 31*b* of said bore 31.

Bull nose end cap 50 generally comprises a cap member having a rounded leading end surface 51 and central bore 52. Said central bore 52 is sized and configured to be received on bull nose extension member 33. Inner profile 53 can engage and mate with retaining rings 34 on the external surface of bull nose extension member 33 to secure said bull nose end cap 50 to said bull nose extension member 33. End port 54 extends through said rounded end surface 51 of bull nose end cap 50 and is generally aligned with bore 31 when said end cap 50 is installed on said bull nose extension member 33. Said bull nose cap 50 can be constructed of urethane or other non-abrasive material, and acts to reduce abrasion, gouging or other damage to downhole equipment (such as, for example, when the jetting sub assembly of the present invention is being moved in or out of a well, or reciprocated within said well).

Bull nose end cap 50 is operationally attached to the distal end of jetting sub assembly 100. Said bull nose end cap 50 can be constructed of urethane, plastic polymer or other non-abrasive material. Bull nose end cap 50 acts to reduce abrasion, gouging or other damage to downhole equipment that may come in contact with jetting sub assembly 100 (such as, for example, when said jetting sub assembly 100 is being moved in or out of the well, or reciprocated within said well).

In a preferred embodiment, jetting sub assembly 100 of the present invention comprises a substantially tubular first sub member 10, providing conventional pin-end threaded connection member 13 and box-end threaded connection member 12 for inclusion of said jetting sub assembly 100 within, or at the distal end of, a tubular work string. Said jetting sub assembly 100 beneficially has the same threaded end connections 12 and 13 as drill pipe and, thus, can be used in-line with the drill string for jetting in a short trip of downhole equipment (including, without limitation, BOPs, wellheads, subsea equipment and trees). When desired, second sub member 30 can be attached to form a combined assembly when said jetting sub assembly 100 is run on the distal or leading end of a tubular work string (such as, for example, as part of a "dedicated" run where a jetting operation is the sole purpose for a pipe run).

Figure 5:
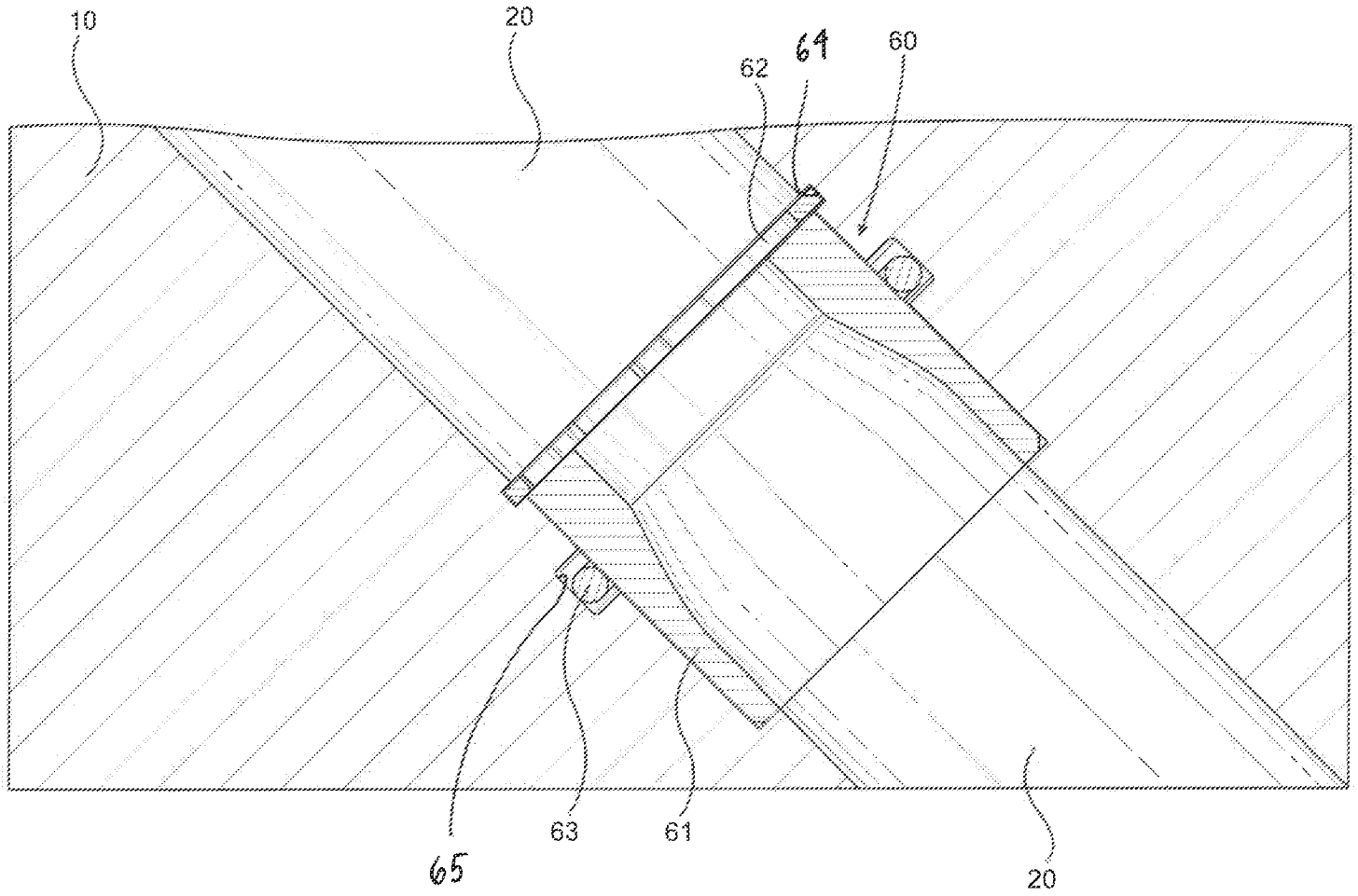
FIG. 5 depicts a detailed view of a highlighted portion of the jetting sub assembly depicted in FIG. 4.

FIG. 5 depicts a detailed view of a highlighted portion of jetting sub assembly 100 depicted in FIG. 4 and, more specifically, first nozzle assembly 60 disposed within a recess in bore 20. In the embodiment depicted in FIG. 5, bore 20 extends through first sub member 10 and is oriented at an acute angle relative to the longitudinal axis of central through bore 11 (not visible in FIG. 5). Said first nozzle assembly 60 further comprises nozzle member 61, snap ring 62 and elastomeric seal member 63; snap ring 62 can be received within groove 64 formed around bore 20, while elastomeric seal member 63 can be received within groove 65 formed around bore 20. Although other materials can be employed without departing from the scope of the invention, elastomeric seal member 63 can comprise a rubber O-ring. Snap ring 62 secures said first nozzle member 61 in place within bore 20, while elastomeric seal member 63 provides a fluid pressure seal to direct pressurized fluid through nozzle member 61.

Figure 6:
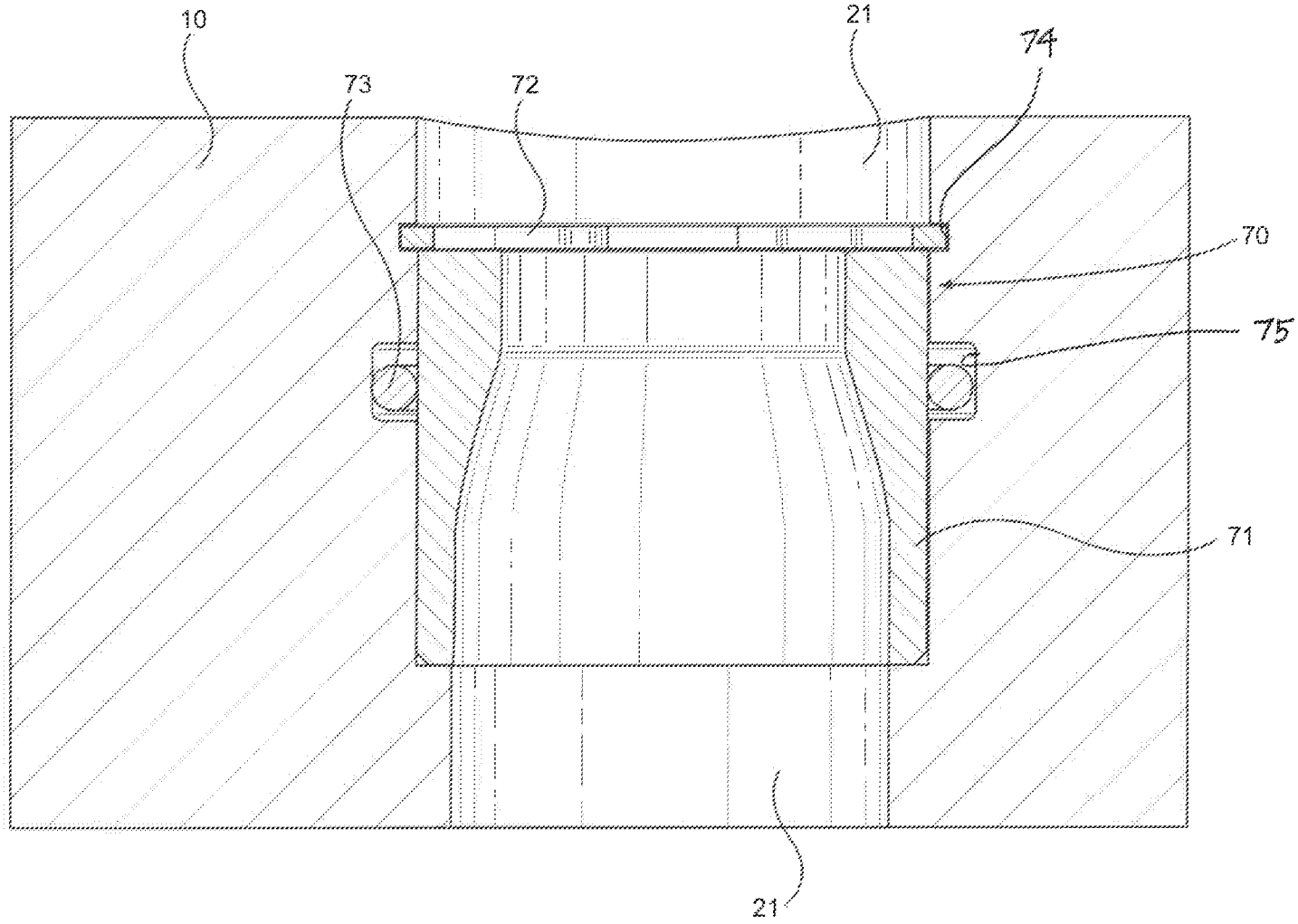
FIG. 6 depicts a detailed view of a highlighted portion of the jetting sub assembly depicted in FIG. 4.

FIG. 6 depicts a detailed view of a highlighted portion of jetting sub assembly 100 depicted in FIG. 4 and, more specifically, second nozzle assembly 70 disposed within bore 21. Bore 21 extends through first sub member 10 and, in the specific configuration depicted, is oriented at normal or 90-degree angle relative to the longitudinal axis of central through bore 11 (not visible in FIG. 6). Said second nozzle assembly 70 further comprises nozzle member 71, snap ring 72 and elastomeric seal member 73; snap ring 72 can be received within groove 74 formed around bore 21, while elastomeric seal member 73 can be received within groove 75 formed around bore 21. Although other materials can be employed without departing from the scope of the invention, elastomeric seal member 73 can comprise a rubber O-ring. Snap ring 72 secures said second nozzle member 71 in place within bore 21, while elastomeric seal member 73 provides a fluid pressure seal to direct pressurized fluid through nozzle member 71.

Figure 7:
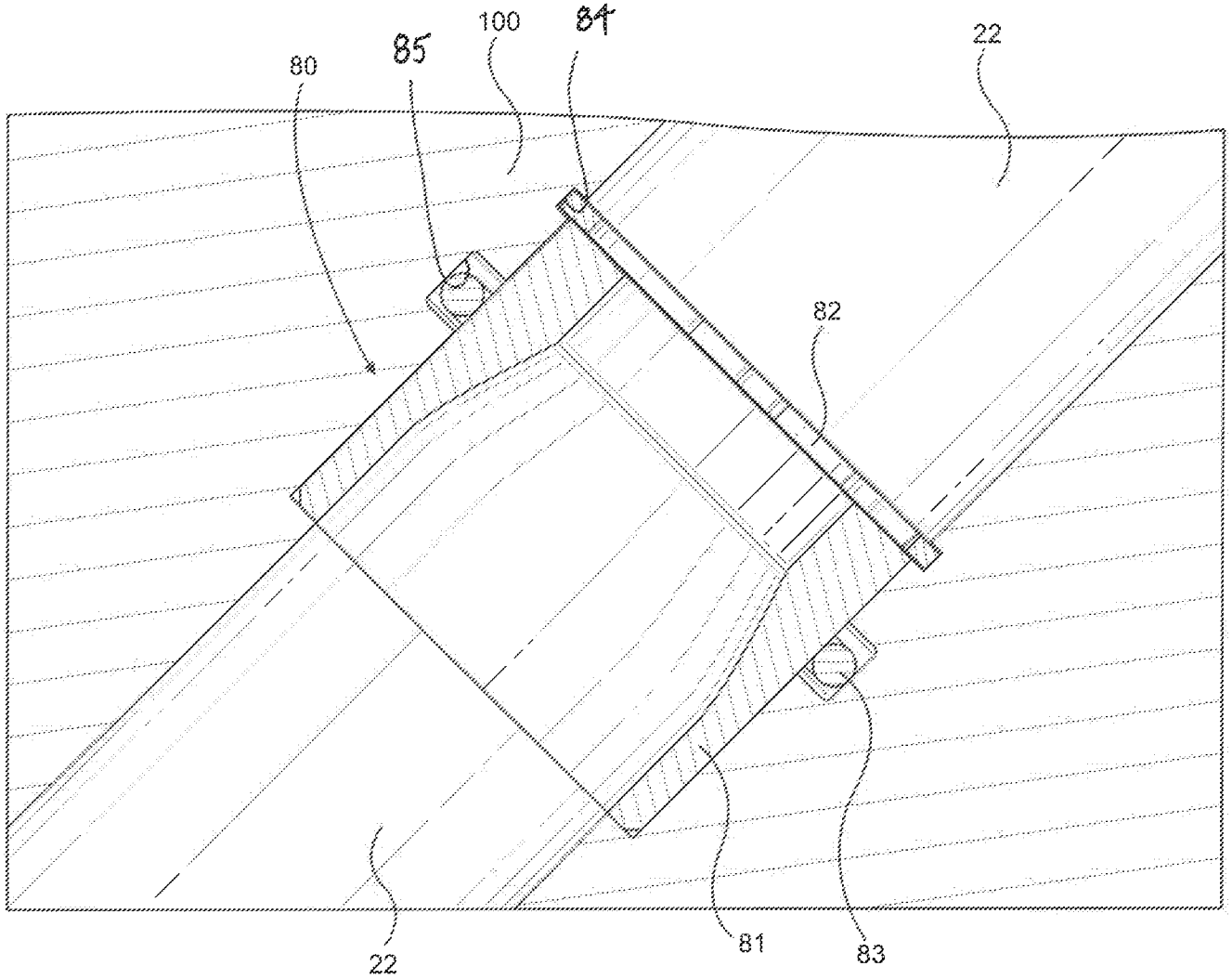
FIG. 7 depicts a detailed view of a highlighted portion of the jetting sub assembly depicted in FIG. 4.

FIG. 7 depicts a detailed view of a highlighted portion of jetting sub assembly 100 depicted in FIG. 4 and, more specifically, third nozzle assembly 80 disposed within bore 22. Bore 22 extends through first sub member 10 and is oriented at an acute angle relative to the longitudinal axis of central through bore 11 (not visible in FIG. 7). Said third nozzle assembly 80 further comprises nozzle member 81, snap ring 82 and elastomeric seal member 83; snap ring 82 can be received within groove 84 formed around bore 22, while elastomeric seal member 83 can be received within groove 85 formed around bore 22. Although other materials can be employed without departing from the scope of the invention, elastomeric seal member 83 can comprise a rubber O-ring. Snap ring 82 secures said third nozzle member 81 in place within bore 22, while elastomeric seal member 83 provides a fluid pressure seal to direct pressurized fluid through nozzle member 81.

Figure 8:
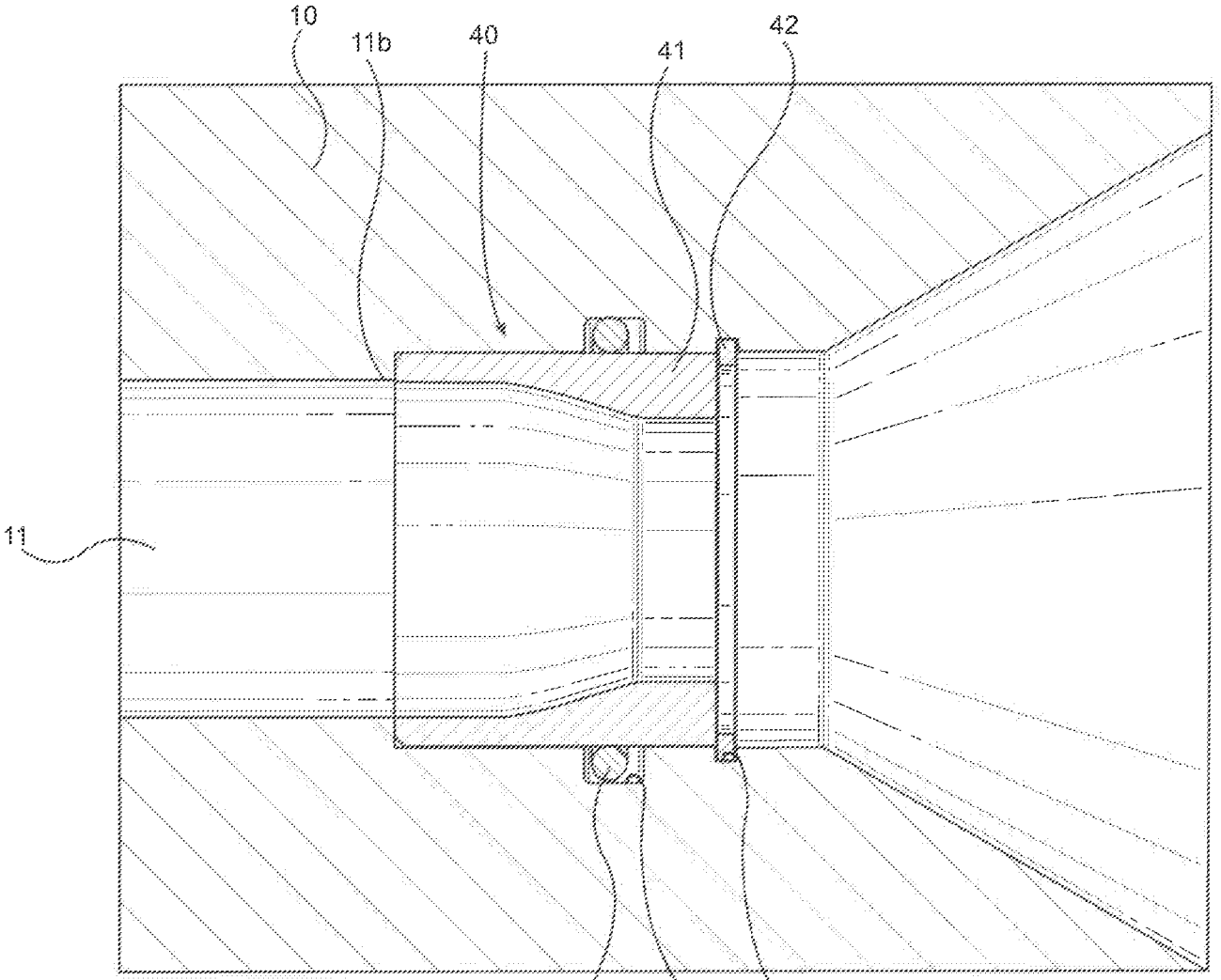
FIG. 8 depicts a detailed view of a highlighted portion of the jetting sub assembly depicted in FIG. 4.

FIG. 8 depicts a detailed view of a highlighted portion of jetting sub assembly 100 depicted in FIG. 4 and, more specifically, in-line nozzle assembly 40 disposed within bore 11 near end 11*b*. Central through bore 11 extends through first sub member 10. Said in-line nozzle assembly 40 further comprises nozzle member 41, snap ring 42 and elastomeric seal member 43; snap ring 42 can be received within groove 44 formed around bore 11, while elastomeric seal member 43 can be received within groove 45 formed around bore 11. Although other materials can be employed without departing from the scope of the invention, elastomeric seal member 43 can comprise a rubber O-ring. Snap ring 42 secures said nozzle member 41 in place within central through bore 11, while elastomeric seal member 43 provides a fluid pressure seal to direct pressurized fluid through nozzle member 41.

Figure 9:
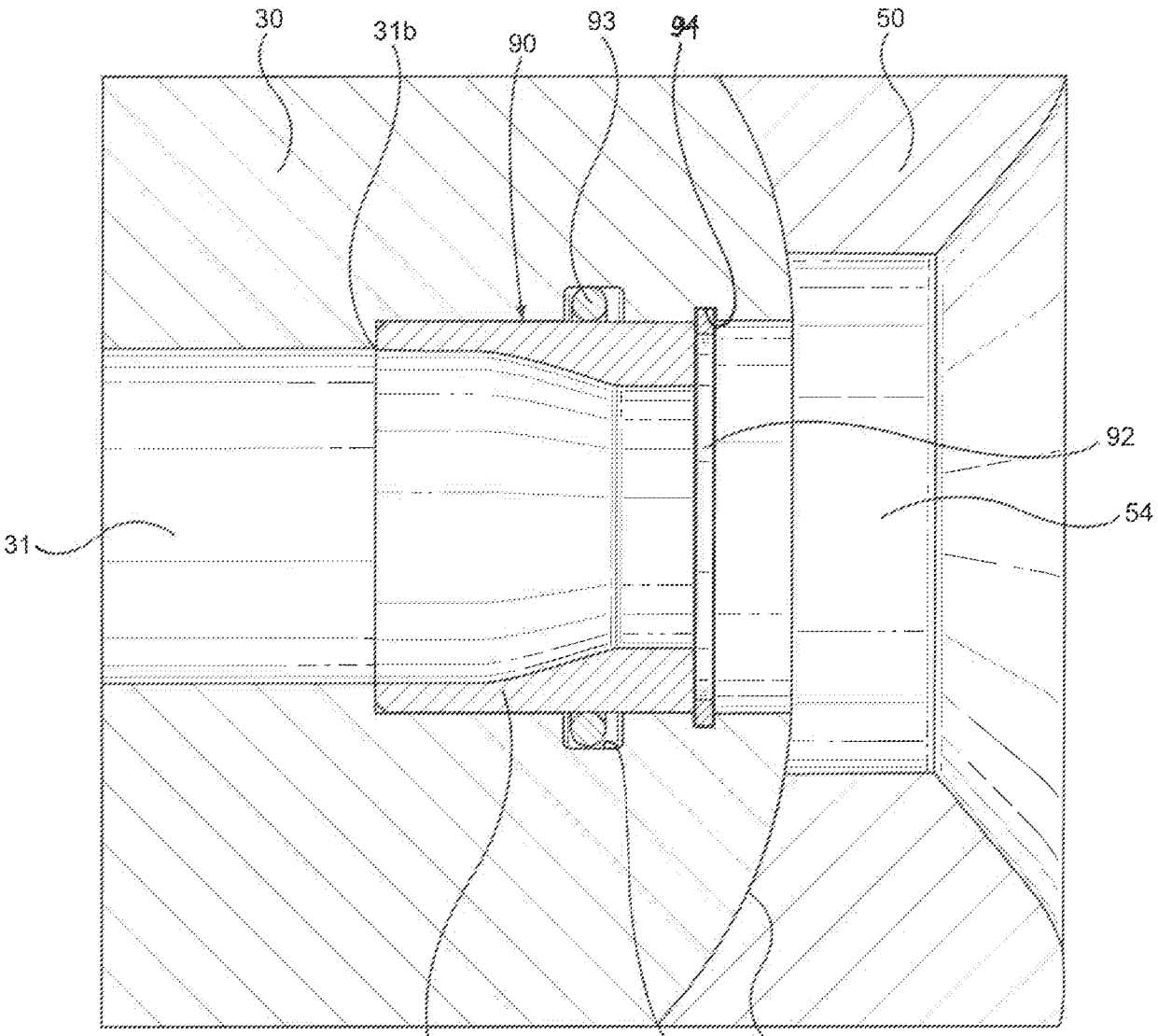
FIG. 9 depicts a detailed view of a highlighted portion of the jetting sub assembly depicted in FIG. 4.

FIG. 9 depicts a detailed view of a highlighted portion of jetting sub assembly 100 depicted in FIG. 4 and, more specifically, end nozzle assembly 90 disposed within bore 31 of second sub member 30 near end 31*b*. Bull nose end cap 50 is sized and configured to be received on bull nose extension member 33. End port 54 extends through bull nose end cap 50 and is generally aligned with bore 31. Said end nozzle assembly 90 further comprises nozzle member 91, snap ring 92 and elastomeric seal member 93; snap ring 92 can be received within groove 94 formed around bore 31, while elastomeric seal member 93 can be received within groove 95 formed around bore 31. Although other materials can be employed without departing from the scope of the invention, elastomeric seal member 93 can comprise a rubber O-ring. Snap ring 92 secures said nozzle member 91 in place within bore 31, while elastomeric seal member 93 provides a fluid pressure seal to direct pressurized fluid through nozzle member 91.

Jetting sub assembly 100 of the present invention also includes a nose port and in-line nozzle assembly 40. When desired, a blank plug (instead of nozzle 41) can be installed in said nozzle assembly 40, permitting the end to blank off and run in the drill string during short trips without having to run a valve below said jetting sub assembly 100 (like with conventional jet subs). When second sub member 30 is attached, end nozzle assembly 90 can include a nozzle 91 having a desired size and spray pattern (including, if desired, blanked-off or closed ended).

In a preferred embodiment, jetting sub assembly 100 accepts drop-in nozzles similar to conventional tri-cone bit nozzles; such nozzles can beneficially be readily available ("off the shelf") and easier to install and remove than screw-in type nozzles. Said drop-in nozzles can be generally available in multiple sizes, thereby permitting re-dressing or re-configuration of the jetting sub assembly 100 of the present invention on location (such as on a drilling rig), as well as customization of desired fluid jetting pattern(s), including, without limitation, to satisfy particular job parameters. Said nozzles are readily available and easier to install and remove than conventional screw-in type nozzles, and also come in various sizes thereby allowing an operator to re-dress a tool on location (such as on a drilling rig) and re-direct flow as desired (including, without limitation, to satisfy particular job parameters). Further, jetting ports can be selectively positioned or oriented during manufacture, and can be closed off or flow restricted as desired, either in said end cap or along the body of the jetting sub assembly 100.

More specifically, in a preferred embodiment, said nozzles 41, 61, 71, 81, and 91 comprise conventional and readily available nozzles so that the fluid jet flow pattern from said jetting sub assembly 100 can be designed or customized for enhanced jetting and customized fluid spray pattern and/or coverage. By way of illustration, but not limitation, said fluid spray pattern can be angled at an acute angle relative to the longitudinal axis of said jetting sub assembly and surrounding wellbore; for example, said spray pattern can be directed 45 degrees up-hole (nozzle assembly 60 in bore 20), 45 degrees down-hole (nozzle assembly 80 in bore 22), at 90 degrees (nozzle assembly 70 in bore 21), blanked off, or full open. As such, the jetting sub assembly 100 of the present invention provides flexibility to adjust fluid flow pattern, nozzle size, and total flow area at virtually any position along the length of the tool body in multiple directions for desired applications.

Figure 10:
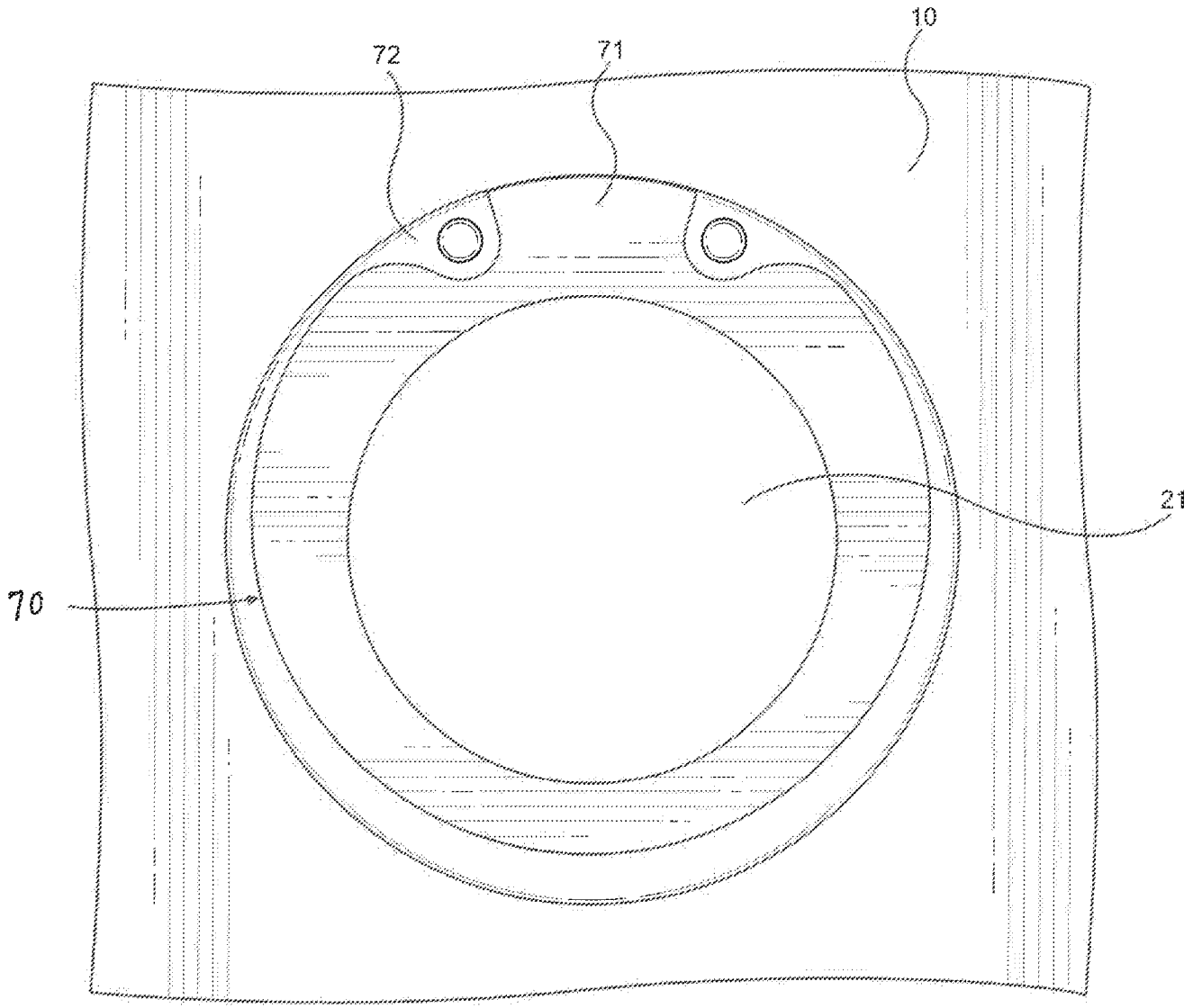
FIG. 10 depicts a detailed view of a highlighted portion of the jetting sub assembly depicted in FIG. 4.

FIG. 10 depicts a detailed end view of a highlighted portion of jetting sub assembly 100 depicted in FIG. 4 and, more specifically, second nozzle assembly 70 disposed within bore 21. Bore 21 extends through first sub member 10 and is oriented at normal or 90-degree angle relative to the longitudinal axis of central through bore 11 (not visible in FIG. 10). Said second nozzle assembly 70 further comprises nozzle member 71 and snap ring 72. Snap ring 72 secures said nozzle member 71 in place within bore 21, but allows for quick and efficient removal and replacement of said nozzle member 71 when desired.

In operation, jetting sub assembly 100 of the present invention can be operationally attached to the distal or leading end of a tubular work string, included (typically without sub member 30) as an in-line component part of said tubular work string or, in certain circumstances, in both configurations/locations simultaneously. Fluid can be pumped from a drilling rig or other surface location into said tubular work string, through the nozzles of said jetting sub assembly 100, and selectively directed at the internal surface(s) of a wellbore or associated equipment (such as, for example, BOP's, risers or subsea wellhead equipment). Debris or other materials can be cleaned from said internal surface(s) and circulated to back out of the well for ultimate disposal or other disposition.

Rig time and associated costs can be saved by reducing the number pipe trips required, as well as the time required for jetting operations, thereby allowing for operational efficiencies. Jetting sub assembly 100 of the present invention improves jetting/cleaning of internal surfaces of BOP, wellhead, and subsea equipment due to improved jet configuration and, thus, improved fluid jetting coverage. Further, the jetting sub assembly of the present invention allows for enhanced versatility for directional fluid jetting, along with adjustability of nozzle size and configuration selection.

Jetting sub assembly 100 of the present invention further provides better cleaning of BOP's and other well equipment, thereby reducing surface maintenance times and improving health, safety and environmental performance due to less debris in internal recesses, spaces or cavities of downhole components. Jetting sub assembly 100 utilizes adjustable nozzle ports that can be dressed open or closed to direct desired fluid flow and TFA, together with other benefits including, without limitation: internal O-Ring grooves for fluid pressure sealing capabilities around said nozzles; retainer rings for retention of said nozzles (as well as quick and efficient removal and replacement of same); high max working pressure ("MWP") of 3,500 psi or more, allowing for greater differential pressure across said nozzles (and retainer rings and O-rings); and customization of multiple different nozzle sizes and configurations.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A jetting sub apparatus comprising:

a) a first sub assembly comprising:

i) a body section having a first end, a second end, an outer surface and a central through bore extending from said first end to said second end, and at least one transverse bore extending from said central bore to said outer surface;

ii) a first threaded connection member disposed at said first end;

iii) a second threaded connection member disposed at said second end;

b) at least one nozzle removeably disposed in said central bore or said at least one transverse bore;

c) a second sub assembly comprising:

i) a body section having a first end, a first threaded connection member disposed at said first end, a second end, and a central through bore extending from said first end to said second end, wherein said first threaded connection member of said second sub member is configured to mate with said second threaded connection member of said first sub member;

ii) a bull nose extension disposed at said second end of said body section of said second sub assembly; and d) an end cap disposed on said bull nose extension, wherein said end cap is constructed of non-abrasive material and wherein said non-abrasive material comprises urethane or plastic polymer.

2. A method for cleaning internal surfaces of a wellbore comprising:

a) providing a jetting sub assembly comprising:

i) a first sub assembly comprising:

aa) a body section having a first end, a second end, an outer surface and a central through bore extending from said first end to said second end, and at least one transverse bore extending from said central bore to said outer surface;

bb) a first threaded connection member disposed at said first end;

cc) a second threaded connection member disposed at said second end; and ii) at least one nozzle removeably disposed in said central bore or said at least one transverse bore;

iii) a second sub assembly comprising a body section having a first end, a first threaded connection member disposed at said first end, a second end defining a bull nose extension, and a central through bore extending from said first end to said second end, wherein said first threaded connection member of said second sub member is configured to mate with said second threaded connection member of said first sub member;

iv) an end cap disposed on said bull nose extension, wherein said end cap is constructed of non-abrasive material, and wherein said non-abrasive material comprises urethane or plastic polymer;

b) conveying said jetting sub assembly within said wellbore on a tubular work string; and c) pumping fluid through said tubular work string and said jetting sub assembly, and directing said fluid at an internal surface of a wellbore.

3. The method of claim 2, further comprising at least one retaining ring at least partially disposed around said bull nose extension, wherein said end cap is secured on said bull nose extension using said at least one retaining ring.

* * * * *